US006301759B1

(12) United States Patent
Langer et al.

(10) Patent No.: US 6,301,759 B1
(45) Date of Patent: Oct. 16, 2001

(54) YARN, PROCESS FOR PRODUCING A YARN, AND TEXTILE FABRIC

(75) Inventors: Angela Langer; Franz-Josef Kalde, both of Schmallenberg (DE)

(73) Assignee: Falke KG, Schmallenberg (DE)

( * ) Notice: Subject to any disclaimer, the term of this patent is extended or adjusted under 35 U.S.C. 154(b) by 0 days.

(21) Appl. No.: 09/495,963

(22) Filed: Feb. 2, 2000

(30) Foreign Application Priority Data

Feb. 2, 1999 (DE) ..... 199 04 191

(51) Int. Cl.[7] ..... D04B 19/00
(52) U.S. Cl. ..... 28/218; 66/1 R
(58) Field of Search ..... 28/171, 218; 66/178 A, 66/202, 1

(56) References Cited

U.S. PATENT DOCUMENTS

| | | | | |
|---|---|---|---|---|
| 3,330,018 | * | 7/1967 | Silver et al. | 66/178 |
| 3,333,441 | | 8/1967 | Soussloff et al. . | |
| 3,466,718 | * | 9/1969 | Adamson | 66/178 |
| 3,579,764 | * | 5/1971 | Kieffer | 28/218 |
| 3,720,984 | * | 3/1973 | Roberson, Jr. | 28/218 |
| 3,861,176 | * | 1/1975 | McWhirter et al. | 66/137 |
| 4,005,569 | * | 2/1977 | Corbiere | 57/246 |
| 4,057,880 | * | 11/1977 | Matthews et al. | 28/154 |
| 4,086,688 | * | 5/1978 | Dombrowski | 28/218 |
| 4,137,615 | * | 2/1979 | Webster | 66/178 |
| 4,185,364 | * | 1/1980 | Luckenbach | 28/218 |
| 4,411,142 | * | 10/1983 | Regenstein | 66/196 |
| 4,870,839 | * | 10/1989 | Odham | 66/125 A |
| 5,647,842 | | 7/1997 | Kininmonth et al. . | |

FOREIGN PATENT DOCUMENTS

| | | |
|---|---|---|
| 1 913 747 | 11/1969 | (DE) . |
| 196 11 224 A1 | 9/1996 | (DE) . |
| 1 254 923 | 11/1971 | (GB) . |

OTHER PUBLICATIONS

"Crinkled yarn" in Textil Praxis Feb. 1968, pp. 83–84, and English translation of relevant part thereof.

"Knit–de–Knit–method" in Chemiefasern/Textilindustrie, Oct. 1982, and English translation of relevant parts thereof.

* cited by examiner

*Primary Examiner*—Danny Worrell
(74) *Attorney, Agent, or Firm*—Herbert L. Lerner; Laurence A. Greenberg; Werner H. Stemer

(57) ABSTRACT

A yarn which imparts a high level of wearing comfort to a textile portion is produced by forming a knitted portion from the yarn, subjecting the knitted portion to a treatment by which the curl imparted to the yarn by the stitches of the knitted portion is set. The yarn is undone again after the setting step. The yarn has preferably a main thread and an elastic thread. A textile fabric and an article of clothing are also provided.

37 Claims, 2 Drawing Sheets

YARN, PROCESS FOR PRODUCING A YARN, AND TEXTILE FABRIC

BACKGROUND OF THE INVENTION

FIELD OF THE INVENTION

The subject of the invention relates to a process for producing a yarn, to a yarn which is produced in accordance with the process and to a textile portion or fabric which contains the yarn.

The properties of a textile portion or fabric are predominantly determined by the properties of the yarn from which the textile portion is formed. If the textile portion or fabric is an article of clothing, the comfort of wearing the textile portion is considered very important. Articles of clothing are produced from widely varying yarns. Also, different processes are used to produce a yarn. It is for example known that a certain degree of bulk and thus a relatively large volume can be imparted to a yarn by subjecting the yarn during the production process to a texturing operation, in particular to an air texturing operation.

The bulk of a yarn has the result that the yarn has a certain degree of elasticity transversely to the longitudinal direction. Such an elasticity is however relatively slight. If the textile portion is an article of clothing having regions to which relatively high pressures are applied by the part of the body of the person wearing the article of clothing, it would be desirable for those regions of the article of clothing to be such that they are elastically yielding.

The Published European Patent Application EP 0 024 211 A1 describes that an article of clothing, in particular a sock, is formed in the foot contact or sole region with a damping portion whereby the loading of the foot during for example a sporting activity is to be reduced. The foot sole region is in the form of terry towel loops. Such loops increase the expenditure during production and also result in an increased amount of space being required within a shoe.

SUMMARY OF THE INVENTION

It is accordingly an object of the invention to provide a process for producing a yarn which overcomes the above-mentioned disadvantages of the heretofore-known processes of this general type and which can be carried out with a relatively low expenditure. A further object of the invention is to provide a yarn which has an increased level of elasticity. Another object of the invention is to provide a textile portion which in particular has improved wearing properties.

With the foregoing and other objects in view there is provided, in accordance with the invention, a process for producing a yarn, which includes the steps of forming a knitted portion with a yarn for imparting a curl to the yarn with stitches of the knitted portion; subjecting the knitted portion to a setting treatment for setting the curl imparted to the yarn by the stitches of the knitted portion; and unraveling the knitted portion after the setting treatment.

With the objects of the invention in view there is also provided, a yarn, including a yarn body having a curl imparted on the yarn body by knitting the yarn body, setting the curl with a setting treatment, and unravelling the yarn body after the knitting and setting operations.

The structural configuration of the yarn, such as the configuration of the curl is determined by the knitting operation and in particular by the stitches of the knitted portion. Different types of stitches result in different types of curls, such that there is a relationship between a given type of stitches or knitting and a given type of curl.

Surprisingly it was found that a yarn which is produced by a procedure whereby firstly a knitted portion or knitted fabric is formed from a yarn and the knitted portion is subjected to a treatment by which the curl, curving, or crimp imparted to the yarn by the stitches of the knitted portion is set and after the setting step the yarn is undone again, can enhance the wearing comfort of an article of clothing made from the yarn. The yarn produced in that way is available for further processing. The process according to the invention provides a possible way of producing yarn which has an enhanced elasticity in the longitudinal direction of the yarn. The process can be carried out in a simple manner and requires only simple devices. The process according to the invention also affords the option of producing yarns of different configurations. Differing curls or crimps can be imparted to the yarns according to the configuration of the knitting and thus according to the stitches of the knitted portion. It is also possible to form different stitches within a knitted portion so that the yarn has portions with differing curls. The yarn may in particular be of a zigzag or meander-shaped configuration.

According to an advantageous mode of the invention, it is proposed that firstly at least a basic or main thread is twisted with at least one elastic thread. That procedure has the advantage that the yarn can be formed from threads with differing functionalities. The main thread has imposed thereon the curl which determines the appearance of the yarn.

According to a further advantageous mode of the invention, it is proposed that ELASTAN as the elastic thread is twisted with the main thread. ELASTAN is preferably a chemical fiber which is extremely stretchable and which after the removal of a tensile force returns substantially to the original state. ELASTAN are fibres of high polymers which contain at least 85% by weight of segmented polyurethanes. The elastic thread can also include a thread of synthetic polyisoprenes or high polymers which are produced by polymerisation of one or more dienes, possibly with the addition of one or more VINYL monomers. Preferably the elastic thread is ELASTAN with a denier (titer) of dtex 20 wound around with dtex 78/1PA.

In accordance with a still further advantageous mode of the invention, it is proposed that the elastic thread is a rubber thread, in particular a natural rubber. Alternatively it is proposed that the elastic thread is a bi-component fibre, in particular of polyamide and polyurethane.

In accordance with a another advantageous mode of the invention, it is proposed that a main thread which at least partially includes a natural material is twisted with an elastic thread. The main thread is advantageously a main thread which contains wool and/or cotton. The main thread which partially contains wool and/or cotton can also contain mixes of chemical threads or chemical fibers.

In accordance with a further advantageous mode of the invention, it is proposed that the main thread and the elastic thread are twisted at a rotary speed of up to 600 rotations or revolutions per meter. That affords an adequate twisting effect for the threads, while also ensuring that a minimum degree of curl of the yarn is made possible. Preferably the main thread and the elastic thread are twisted at a rotary speed or revolution frequency of between 150 and 250 revolutions per meter. In particular, the main thread and the elastic thread are preferably twisted at a rotary speed of about 200 revolutions per meter.

In order to ensure that during the twisting operation no yarn breakage or thread breakage occurs it is proposed that the main thread and the elastic thread are twisted with a prestressing of up to 10 g. Preferably the main thread and the elastic thread are twisted with a degree of prestressing of between 2 and 6 g, in particular between 3 and 4 g.

In accordance with a still further advantageous mode of the invention, it is proposed that a knitted portion in tape or band form is formed. A band-form knitted portion simplifies handling when it is subjected to a setting operation.

In accordance with another mode of the invention, it is proposed that a substantially tubular knitted portion is formed. The operation of producing a tubular knitted portion can be performed for example through the use of a circular knitting machine.

In accordance with a still further mode of the invention, it is proposed that prior to the setting operation the knitted portion is subjected to at least one cleaning and/or stain removing or detaching step. Such a preliminary treatment of the knitted portion prior to the setting operation has the advantage that the yarn of the knitted portion always has the same properties for the setting step.

In accordance with still another mode of the invention, it is proposed that the setting operation is effected by chemical setting. For that purpose it is proposed that the knitted portion is treated with a setting agent. The setting agent reacts with the main thread so that the main thread is substantially set in the configuration which is predetermined by the stitches of the knitted portion. Advantageously the setting agent is an agent which involves a sulfide, in particular an organically stabilized sulfide.

Chemical setting through the use of a setting agent can also be effected with the addition of a cleaning and/or stain removing or detaching agent so that setting, cleaning and/or stain removing or detaching take place in one process step. The advantage of this procedure can be seen in the fact that the number of steps in the process is reduced.

If setting takes places chemically it is desirable for the knitted portion after the setting operation to be subjected to at least one cleaning and/or neutralizing operation. During the cleaning and/or neutralizing operation the setting agent and possibly the cleaning and/or stain removing agent are washed out of the knitted portion. Preferably the knitted portion is dried after the at least one cleaning and/or neutralizing operation and possibly rinsing operation. Drying of the knitted portion is preferably effected at a temperature of up to 120° C., preferably at 110° C.

For still further improving the setting effect when the setting is effected chemically it is proposed that the knitted portion prior to the treatment with a setting agent is subjected to a steam treatment so that a certain degree of presetting is already achieved by the steam treatment. The steam treatment is preferably effected at a temperature of up to 110° C., in particular at a temperature of between 100 and 102° C. Surprisingly it has been found that the steam treatment can be a relatively short-duration treatment. It is therefore proposed that the knitted portion is treated with steam for a period of up to 20 minutes, preferably up to 15 minutes.

In accordance with a still further mode of the invention, it is proposed that setting of the knitted portion is effected by the knitted portion being treated with steam under pressure. This setting operation which is referred as physical setting has the advantage that no chemical setting agents are required. Setting is preferably effected at a temperature of up to 120° C., preferably at 90° C.

In accordance with a further mode of the invention, it is proposed that the steam treatment is effected at a pressure of 1 bar, in particular at pressure below atmospheric. Treatment of the knitted portion can be effected in a so-called autoclave. The knitted portion can be treated with the steam at reduced pressure for a period of up to 15 minutes, preferably for 10 minutes.

The yarn according to the invention is extremely stretchable and after removal of the tensile force returns substantially to the original state. The yarn can be of zigzag or meander-shaped appearance. The external appearance of the yarn is substantially determined by the formation of the stitches of the knitted portion and the setting of the curl.

With the objects of the invention in view there is also provided, a textile portion which has at least one knitted region, wherein the region is formed by at least one yarn which has at least one part which is produced according to the process according to the invention. The knitted region, in which the yarn has a part which is produced according to the process of the invention, has an enhanced elasticity transversely with respect to the longitudinal direction of the region. By virtue of the fact that the yarn received a curl due to the setting effect, that curl is retained even when knitting the region. As a result a higher yarn volume is introduced into the knitted region and that higher volume has a damping property.

The technical purposes. Preferably the textile portion is an article of clothing which due to the at least one knitted region has a higher level of wearing comfort. Preferably the article of clothing is a sock. The term sock is used synonymously for an article of legwear or hosiery. This may also involve for example a stocking, a half-sock or the like.

Preferably the foot contact or sole region of the sock is at least partially formed by the yarn. That provides that in the foot contact or sole region a higher degree of damping is achieved without the foot contact or sole region having a foot contact or sole region which is substantially thicker than conventional socks.

In accordance with further advantageous embodiments of the textile portion, the sock has a at least a heel region and/or a toe region which are each at least partially formed by the yarn. This increases the wearing comfort of the socks.

In accordance with a still further advantageous embodiment of the textile portion it is proposed that the at least one region is formed by at least one basic yarn passing therethrough and by the at least one yarn.

Other features which are considered as characteristic for the invention are set forth in the appended claims.

Although the invention is illustrated and described herein as embodied in a yarn, a textile portion, and a process for producing a yarn it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
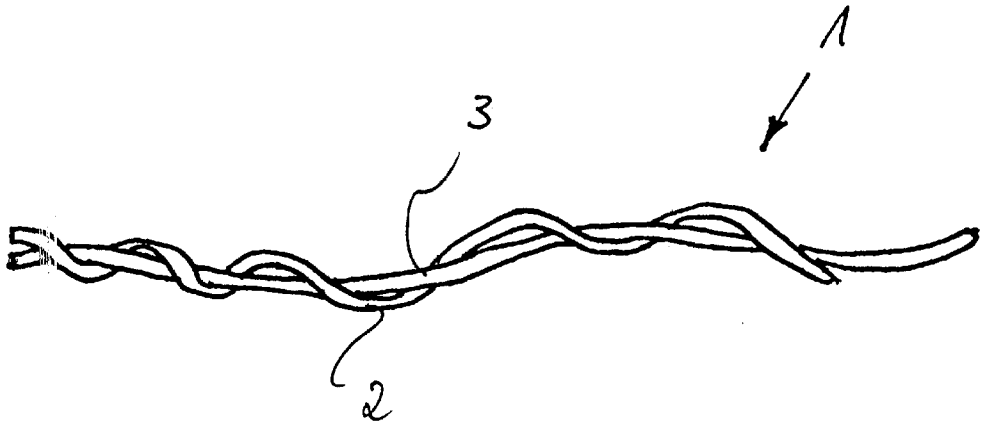
FIG. 1 is a diagrammatic view of a main thread which is twisted with an elastic thread.

In the following, an exemplary process for producing a yarn is described. An elastic thread with dtex 20 LYCRA wound around with dtex 78/1 PA is twisted with a main thread of the type Nm 44/2 Wo-PA (80/20 homogenous mix). The twisting operation is effected at 200 revolutions per meter in a Z-direction. The twisting operation is effected with a prestressing of between 3 and 4 g.

The yarn produced in that way is used to knit a knitted portion or knitted fabric in the form of a knitted tube or hose. The knitting operation is performed on a small circular knitting machine of a diameter of 25.4 cm (10"), the number of needles being 312.

The knitted portion is then subjected to a setting process. Firstly the knitted portion is steamed in the steamer with steam at a temperature of between 100° C. and 102° C. for 15 minutes. Thereafter the knitted portion is subjected to a setting operation. For that purpose the knitted portion is treated with a setting agent containing 50 g/l WOLLPERMAN SA from the company Chemische Fabrik Tübingen CHT R Beitlich GmbH and with 0.3 g/l DIADAVIN NSE from the company Bayer AG. The treatment operation is performed in a SPACEDYE installation. The setting operation is followed by a neutralisation of the knitted portion with hydrogen peroxide. Thereafter the knitted portion passes through two rinsing baths and a drying operation. Drying of the knitted portion is effected at 110° C. After the drying operation the yarn of the knitted portion is unravelled, in other words it is undone again, and is coiled up to form a yarn bobbin or package.

The yarn obtained in that way is of a meander shape and it is highly elastic.

Instead of the knitted portion being set through the use of a chemical setting action, the setting can also be effected by the knitted portion being exposed to a partial vacuum in an autoclave. The knitted portion is treated in the autoclave at a steam temperature of 90° C. and for a period of 10 minutes. After that the knitted portion is cooled down. The yarn of the knitted portion can be undone again. This operating procedure in the setting step also provides that the yarn is of a substantially meander-shaped configuration.

FIG. 1 diagrammatically shows a yarn 1 which is formed by a main thread 2 and an elastic thread 3. The main thread 2 and the elastic thread 3 are twisted together. The main thread 2 is preferably wool and/or cotton, wherein additional chemical fibers may be contained in the main thread 2. The elastic thread 3 is preferably ELASTAN. The elastic thread 3 and the main thread 2 are twisted together, with the twisting operation being effected at a rotary speed or revolution number of about 200 revolutions per meter. The twisting operation is effected through the use of known twisting apparatuses, the twisting operation being performed with a prestressing of between 2 g and 4 g.

The yarn shown in FIG. 1 is used to produce a knitted portion or fabric. The knitted portion can be in the form of a tube or hose or in the form of a tape or band. These are the preferred embodiments of the knitted portion. Other forms of a knitted portion are also possible. The knitted portion is subjected to a treatment by which a curvature or curl imparted in the yarn 1 by the stitches of the knitted portion is set. After the setting step the yarn 1 is undone again.

Figure 2:
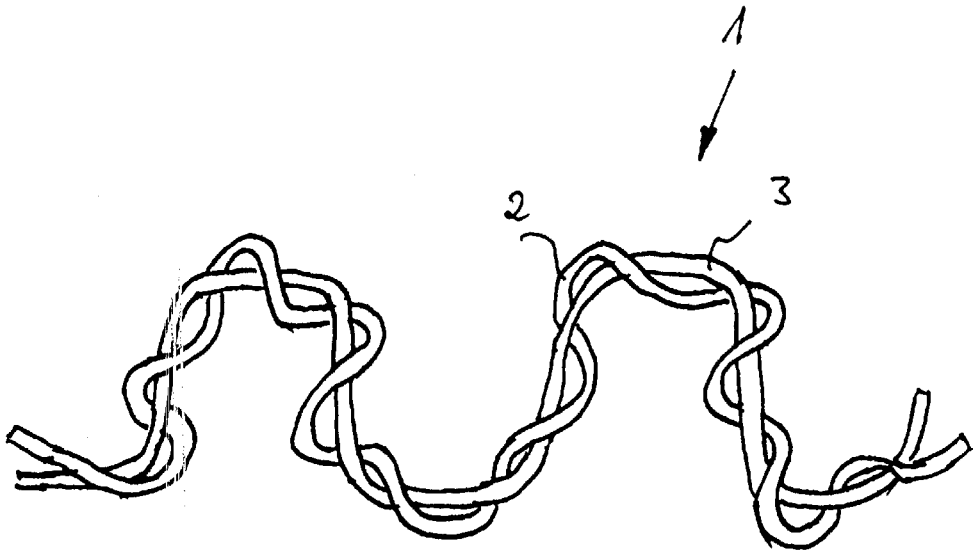
FIG. 2 is a diagrammatic view of a yarn according to the invention.

FIG. 2 diagrammatically shows a portion of a yarn 1 which was firstly knitted to form a knitted portion and subjected to a setting treatment. The portion of the yarn shown in FIG. 2 has a curl which in the illustrated embodiment can be referred as a meander-shaped configuration of the yarn 1. The appearance of the yarn 1 is dependent on how the stitches of the knitting are produced. According to the mode of formation of the stitches differing curls or curvatures can be imparted to the yarn 1. After the setting operation the yarn retains the curl. Setting can be effected through the use of chemical setting agents. Preferably the setting agent is a setting agent which contains a sulfide, in particular organically stabilized sulfide. Cleaning and/or stain removing or detaching agents can be added to the setting agent if needed. The main thread 2 is set by the setting agent so that the yarn, after the unravelling operation, is in a zigzag or meander-shaped configuration, as shown in FIG. 2. The yarn produced in that way can be passed to further uses.

In particular, the setting of the knitted portion may be performed in a section-wise or portion-wise manner, which makes it possible to produce a yarn 1 which has a corresponding portion-wise or section-wise zig-zag or meander-shaped configuration.

Figure 3:
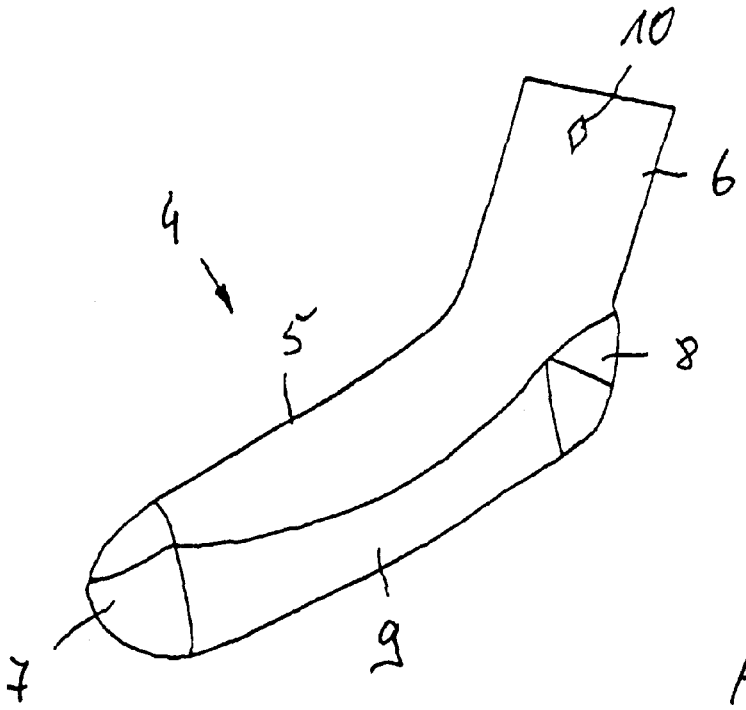
FIG. 3 is a diagrammatic front view of a sock.

FIG. 3 shows by way of example a textile portion which is a sock. Other textile portions or portions which have a textile part with at least one knitted region, wherein the region is formed by at least one yarn having at least one part, that is manufactured in accordance with the process of the invention, can of course also be provided.

FIG. 3 shows a front view of a sock 4. The sock has a foot region 5 and a leg region 6. The front end region of the foot region 5 is formed by a reinforced toe region 7. The heel region 8 formed opposite from the toe region 7 is also reinforced in the illustrated embodiment. Formed between the toe region 7 and the heel region 8 is a foot contact or sole region 9 which is reinforced relative to the leg region 6 and the foot region 5. The degree of reinforcement of the sole region 9 can correspond to the degree of reinforcement of the toe region 7 and the heel region 8 respectively. Provided in the upper region of the leg region 6 is an optical marking 10 which is knitted into the leg region 6.

The sole region 9 is formed by a yarn 1, as it is shown in FIG. 2. In that way a higher degree of elasticity is imparted to the sole region 9 so that the sock 4 has damping properties. The toe region 7 and the heel region 8 can also be formed with a yarn 1, wherein the yarns 1 which can be used in the sole region 9, the toe region 7 and the heel region 8 can be of different compositions. Thus different main threads and different elastic threads can be contained in the yarn.

Figure 4:
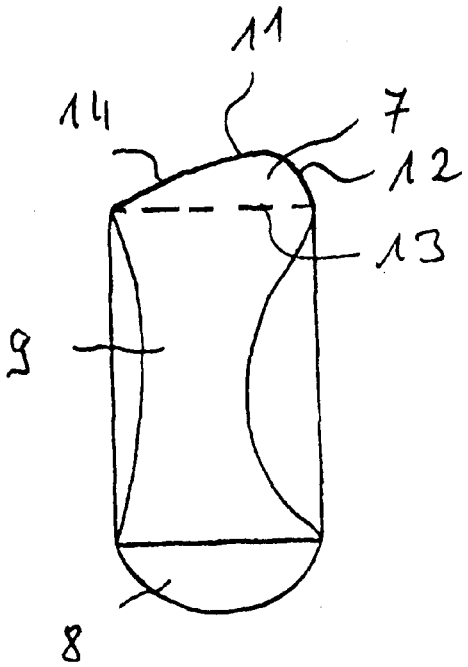
FIG. 4 is a diagrammatic bottom view of the sock of FIG. 3 for a right foot.
Figure 5:
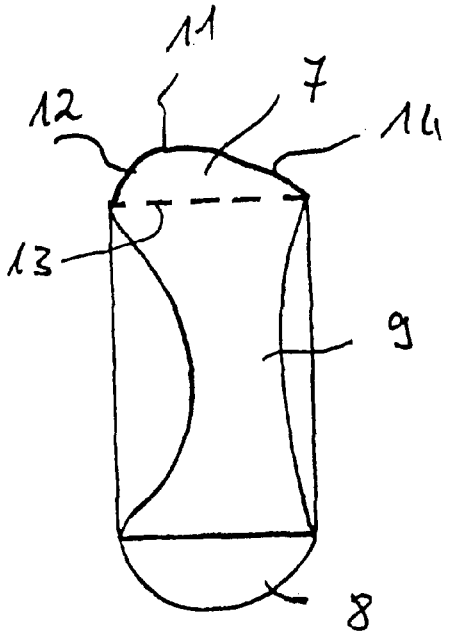
FIG. 5 is a diagrammatic bottom view of the sock of FIG. 3 for a left foot.

FIGS. 4 and 5 show that the sole region 9 is of a configuration substantially corresponding to the sole surface of the foot so that the foot region 5 of the sock 4 is of an ergonomic configuration.

FIGS. 4 and 5 show that the respective heel region 7 in the preferred embodiment has an edge 11 whose configuration or shape substantially corresponds to that of toes. In the illustrated embodiment the toe region 7 is of a substantially trapezoidal configuration. The toe region 7 has an edge portion 12 which when the sock is being worn bears against the big toe of the left or the right foot respectively. The inclination of the edge portion 12 relative to a common base 13, which is shown in broken line in FIGS. 3 and 4 respectively, is less than the inclination of the further edge portion 14. The edge 11 is preferably seam-free so that when the sock is being worn no pressure locations caused by a seam can occur so that the level of wearing comfort of the sock is substantially enhanced in comparison with conventional socks. The toe region 7 can also be knitted throughout.

The textile portion can be formed throughout from a yarn 1. The textile portion can also be such that the yarn 1 is knitted in a region-wise manner, as at least one additional yarn, with a main yarn.

We claim:

1. A process for producing a yarn, the method which comprises:

forming a knitted portion with a yarn for imparting a curl to the yarn with stitches of the knitted portion;

subjecting the knitted portion to a setting treatment for setting the curl imparted to the yarn by the stitches of the knitted portion;

unraveling the knitted portion after the setting treatment; and subjecting the knitted portion to at least one of a cleaning step and a stain removing step, prior to the setting treatment.

2. A process for producing a yarn, the method which comprises:

forming a knitted portion with a yarn for imparting a curl to the yarn with stitches of the knitted portion;

subjecting the knitted portion to a setting treatment for setting the curl imparted to the yarn by the stitches of the knitted portion;

unraveling the knitted portion after the setting treatment; and during the step of subjecting the knitted portion to the setting treatment, treating the knitted portion with a setting agent.

3. The process according to claim 2, wherein the step of subjecting the knitted portion to the setting treatment includes treating the knitted portion with a setting agent containing sulfide.

4. The process according to claim 2, wherein the step of subjecting the knitted portion to the setting treatment includes treating the knitted portion with a setting agent containing an organically stabilized sulfide.

5. The process according to claim 2, wherein the step of subjecting the knitted portion to the setting treatment includes treating the knitted portion with a setting agent containing sulfide and containing at least one of a cleaning agent and a stain removing agent.

6. A process for producing a yarn, the method which comprises:

forming a knitted portion with a yarn for imparting a curl to the yarn with stitches of the knitted portion;

subjecting the knitted portion to a setting treatment for setting the curl imparted to the yarn by the stitches of the knitted portion;

unraveling the knitted portion after the setting treatment; and subjecting the knitted portion to at least one of a cleaning operation and a neutralizing operation after the setting treatment.

7. The process according to claim 6, which comprises rinsing the knitted portion after the neutralizing operation.

8. The process according to claim 6, which comprises drying the knitted portion after the at least one of the cleaning operation and the neutralizing operation.

9. The process according to claim 7, which comprises drying the knitted portion after the rinsing step.

10. The process according to claim 8, which comprises drying knitted portion at a temperature of up to 120° C.

11. The process according to claim 8, which comprises drying the knitted portion at a temperature of substantially 110° C.

12. The process according to claim 2, which comprises subjecting the knitted portion to a steam treatment prior to treating the knitted portion wit h t he setting agent.

13. The process according to claim 2, which comprises subjecting the knitted portion to a steam treatment at a temperature of up to 110° C. prior to treating the knitted portion with the setting agent.

14. The process according to claim 2, which comprises subjecting the knitted portion to a steam treatment at a temperature of between 100° C. and 102° C. prior to treating the knitted portion with the setting agent.

15. The process according to claim 2, which comprises subjecting the knitted portion to a steam treatment for a period of up to 20 minutes prior to treating the knitted portion with the setting agent.

16. The process according to claim 2, which comprises subjecting the knitted portion to a steam treatment for a period of up to 15 minutes prior to treating the knitted portion with the setting agent.

17. A process for producing a yarn, the method which comprises:

forming a knitted portion with a yarn for imparting a curl to the yarn with stitches of the knitted portion;

subjecting the knitted portion to a setting treatment for setting the curl imparted to the yarn by the stitches of the knitted portion;

unraveling the knitted portion after the setting treatment; and during the setting treatment, treating the knitted portion with steam at a partial vacuum.

18. The process according to claim 17, wherein the setting treatment includes treating the knitted portion with steam at a partial vacuum and at a temperature of up to 120° C.

19. The process according to claim 17, wherein the setting treatment includes treating the knitted portion with steam at a partial vacuum and at a temperature of substantially 90° C.

20. A process for producing a yarn, the method which comprises:

forming a knitted portion with a yarn for imparting a curl to the yarn with stitches of the knitted portion;

subjecting the knitted portion to a setting treatment for setting the curl imparted to the yarn by the stitches of the knitted portion;

unraveling the knitted portion after the setting treatment; and during the setting treatment, treating the knitted portion with steam at a pressure of substantially 1 bar.

21. The process according to claim 17, wherein the setting treatment includes treating the knitted portion with steam at a given pressure for a period of up to 15 minutes.

22. The process according to claim 17, wherein the setting treatment includes treating the knitted portion with steam at a given pressure for substantially 10 minutes.

23. The process according to claim 2, which comprises twisting at least one main thread with at least one elastic thread for forming the yarn.

24. The process according to claim 23, which comprises using ELASTAN as the at least one elastic thread for twisting with the at least one main thread.

25. The process according to claim 23, which comprises using a rubber thread as the at least one elastic thread for twisting with the at least one main thread.

26. The process according to claim 23, which comprises using a bi-component thread as the at least one elastic thread for twisting with the at least one main thread.

27. The process according to claim 26, which comprises using a thread containing at least one of wool and cotton as the at least one main thread.

28. The process according to claim 23, which comprises using a bi-component thread formed of polyamide and polyurethane as the at least one elastic thread for twisting with the at least one main thread.

29. The process according to claim 23, which comprises using a thread including at least partially a natural material as the at least one main thread.

30. The process according to claim 23, which comprises twisting the at least one main thread and the at least one elastic thread at a revolution frequency of 600 revolutions per meter.

31. The process according to claim 23, which comprises twisting the at least one main thread and the at least one elastic thread at a revolution frequency of between 150 and 250 revolutions per meter.

32. The process according to claim 31, which comprises twisting the at least one main thread and the at least one elastic thread at a revolution frequency of about 200 revolutions per meter.

33. The process according to claim 23, which comprises twisting the at least one main thread and the at least one elastic thread with a prestressing of up to 10 g.

34. The process according to claim 23, which comprises twisting the at least one main thread and the at least one elastic thread with a prestressing of between 2 g and 6 g.

35. The process according to claim 23, which comprises twisting the at least one main thread and the at least one elastic thread with a prestressing of between 3 g and 4 g.

36. The process according to claim 2, which comprises forming the knitted portion as a substantially band-shaped knitted portion.

37. The process according to claim 2, which comprises forming the knitted portion as a substantially tubular-shaped knitted portion.

* * * * *